US010870564B2

(12) United States Patent
Hayakawa et al.

(10) Patent No.: US 10,870,564 B2
(45) **Date of Patent: *Dec. 22, 2020**

(54) METHOD AND APPARATUS FOR CLEANING FILLER

(71) Applicant: Dai Nippon Printing Co., Ltd., Tokyo (JP)

(72) Inventors: Atsushi Hayakawa, Tokyo (JP); Seiji Kuwano, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/225,460

(22) Filed: Dec. 19, 2018

(65) Prior Publication Data

US 2019/0127197 A1 May 2, 2019

Related U.S. Application Data

(63) Continuation of application No. 14/779,770, filed as application No. PCT/JP2014/056894 on Mar. 14, 2014, now Pat. No. 10,196,252.

(30) Foreign Application Priority Data

Mar. 28, 2013 (JP) ..... 2013-068994

(51) Int. Cl.
*B08B 3/02* (2006.01)
*B67C 3/00* (2006.01)

(52) U.S. Cl.
CPC ..... *B67C 3/005* (2013.01); *B08B 3/02* (2013.01); *B67C 3/001* (2013.01)

(58) Field of Classification Search
None
See application file for complete search history.

(56) References Cited

U.S. PATENT DOCUMENTS 4,585,019 A * 4/1986 Jacobson ..... B01D 41/04 134/103.3
5,018,320 A 5/1991 Anguelo et al.
(Continued)

FOREIGN PATENT DOCUMENTS

DE 20019305 U1 6/2001
DE 102009009244 A1 8/2010
(Continued)

OTHER PUBLICATIONS

International Search Report (PCT/JP2014/056894) dated Jun. 3, 2014.
(Continued)

*Primary Examiner* — Mikhail Kornakov
*Assistant Examiner* — Ryan L. Coleman
(74) *Attorney, Agent, or Firm* — Burr & Brown, PLLC

(57) ABSTRACT

At least one of COP and SOP treatments is performed by spraying a predetermined working fluid from spray nozzles within an aseptic chamber accommodated with a filler in a predetermined order, when such at least one of the COP and SOP treatments is performed, the predetermined working fluid is blasted toward externally of the filler in the predetermined order while moving a movable spray nozzle opposing to the filler around the filler from an outer periphery thereof, thus performing the filler cleaning operation. Accordingly, downtime at the drink filling working can be reduced.

2 Claims, 1 Drawing Sheet

(56) References Cited

U.S. PATENT DOCUMENTS

| | | | |
|---|---|---|---|
| 5,641,460 | A | 6/1997 | Okazoe et al. |
| 6,035,872 | A | 3/2000 | Hess et al. |
| 6,079,460 | A | 6/2000 | Ballan et al. |
| 2008/0083474 | A1 | 4/2008 | Mazzon |
| 2010/0170867 | A1 | 7/2010 | Hayakawa |

FOREIGN PATENT DOCUMENTS

| | | | |
|---|---|---|---|
| EP | 1403187 | A1 | 3/2004 |
| JP | 2000-153245 | A1 | 6/2000 |
| JP | 3315918 | B2 | 8/2002 |
| JP | 2004-299723 | A1 | 10/2004 |
| JP | 2006-186296 | A1 | 7/2006 |
| JP | 2007-022600 | A1 | 2/2007 |
| JP | 2007-331801 | A1 | 12/2007 |
| JP | 2010-189034 | A1 | 9/2010 |
| WO | 2008/012996 | A1 | 1/2008 |

OTHER PUBLICATIONS

Extended European Search Report (Application No. 14774174.8) dated Oct. 31, 2016.

* cited by examiner

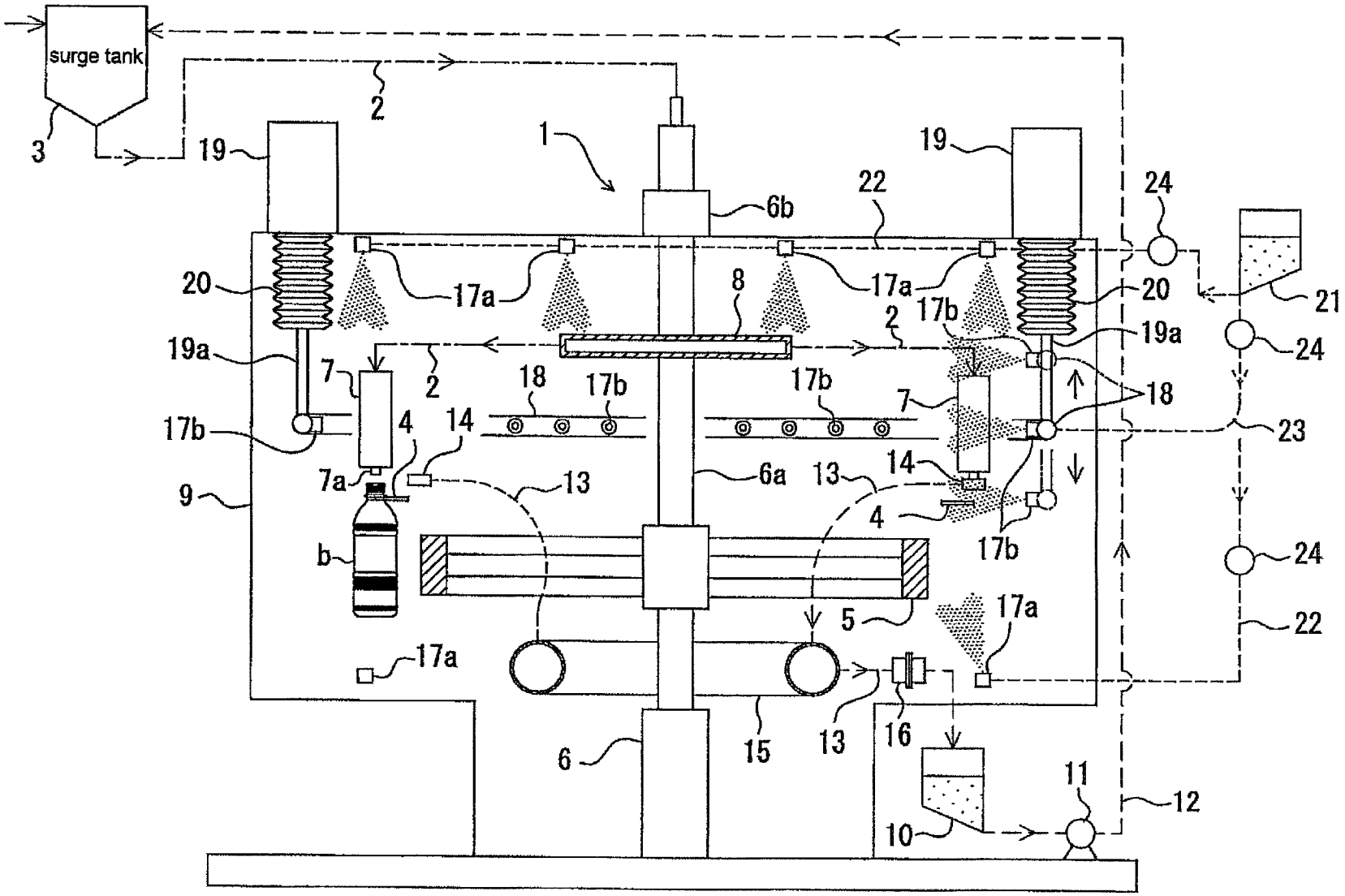
surge tank
1
2
3
4
5
6
6a
6b
7
7a
8
9
10
11
12
13
14
15
16
17a
17b
18
19
19a
20
21
22
23
24
b

METHOD AND APPARATUS FOR CLEANING FILLER

CROSS REFERENCE TO RELATED APPLICATIONS

This application is a continuation of U.S. application Ser. No. 14/779,770, filed Sep. 24, 2015, which in turn is the National Stage of International Application No. PCT/JP2014/056894, filed Mar. 14, 2014, which designated the United States, the entireties of which are incorporated herein by reference.

FIELD OF THE INVENTION

The present invention relates to method and apparatus for cleaning a filler for filling, with drink, a container such as bottle by performing cleaning and sterilizing treatments while turning a number of filling nozzles.

BACKGROUND OF THE INVENTION

A filler as a filling machine for filling a number of bottles with drink at a high speed is provided with a number of filling nozzles arranged at constant pitch along a circumference in a predetermined horizontal plane. The filler is accommodated entirely in an aseptic chamber so as to prevent foreign substance such as bacteria from entering the bottle, which has been subjected to sterilizing treatment and filled with sterilized drink.

When the bottle is filled with drink, the bottles synchronously travelling and reaching below the respectively corresponding filling nozzles of the filler are filled each with a constant amount of drink while all the filling nozzles of the filler being turned all together at high speed. As mentioned above, since the filler is accommodated in the aseptic chamber, such drink filling process is performed in an aseptic condition.

The drink is supplied to the filling nozzles of the filler from a drink preparation device by way of a drink supply pipe line, and the drink supply pipe line is subjected to a CIP (Cleaning in Place) treatment to remove remaining material and/or foreign substance periodically or each time when a kind of drink is changed, and moreover, is subjected to an SIP (Sterilizing in Place) treatment to create an aseptic condition (for example, refer to Patent Documents 1, 2 and 3).

The CIP treatment is performed, for example, by flowing a cleaning liquid prepared with water to which alkaline chemical agent such as caustic soda is added in a flow path from an inside of a pipe line of a drink supply pipe line system to the filling nozzle of a filling machine. According to such treatment, remaining content or substance of previously filled drink adhering to the drink filling path can be removed (for example, refer to Patent Documents 1, 2, and 3).

The SIP treatment is performed, for example, by circulating steam or heated water through the drink filling path cleaned by the CIP treatment mentioned above. According to such treatment, the interior of the drink filling path can be sterilized by the heating of the steam or heated water to thereby sterilize the interior of the drink supply pipe line (for example, refer to paragraph [0003] of Patent Document 3).

At the time when the CIP treatment and the SIP treatment are performed with a liquid such as cleaning liquid, heated water or like, these treatments are performed in the following manner.

Since it is necessary to circulate the liquid inside the drink supply pipe line and/or to recover waste liquid, a cup is applied to a nozzle opening (mouth) portion of each filling nozzle in a static state. Such cups are arranged to be turned together with the filling nozzles. Around the turning axis in the turning motion of the filling nozzles, a manifold is preliminarily arranged so as to be turned together with the filling nozzles and the cups. The cups are connected to the manifold by means of lines, and such manifold is also coupled with a cleaning liquid storage tank and a pump coupled by means of lines in a detachable manner. The cleaning liquid storage tank and the pump are fixed to a machine frame of the filler or the aseptic chamber.

When the CIP treatment and the SIP treatment are performed to the interior of the drink supply pipe line, the turning operation or motion of the filling nozzle and the manifold are stopped, and then, by automatically applying the cup to the opening portion of the filling nozzle to thereby communicate the cup with the manifold, and hence, the manifold and the storage tank storing the cleaning liquid are connected with each other via pipe line. Then, the cleaning liquid in the storage tank flows into the drink supply pipe line and circulates therein for a predetermined time. According to such motion, the interiors of the drink supply pipe line and the filling nozzles are subjected to the CIP treatment. Further, when the SIP treatment is performed using a liquid such as heated water, similar to the case of the CIP treatment, the heated water or like flows inside the drink supply pipe line and inside the filling nozzle, so that the interiors of the drink supply pipe line and the filling nozzle can be sterilized.

Further, a COP (Cleaning out of Place) treatment and an SOP (Sterilizing out of Place) treatment are performed for the purpose of cleaning the inside of the aseptic chamber (for example, refer to Patent Documents 4, 5, 6).

Various kinds of spray nozzles are arranged to various portions within the aseptic chamber, and when the COP and SOP treatments are performed, alkaline cleaning agent, acetyl hydroperoxide cleaning agent, chemical liquid or solution of hydroperoxide hydrogen water, aseptic water or like is sprayed in form of mist or shower into the aseptic chamber from each of the filling nozzles. By the mist or shower of such chemical liquid or water, the inner wall surface of the aseptic chamber and the surfaces of equipments such as filler can be cleaned and hence sterilized.

PRIOR ART DOCUMENT

Patent Document

Patent Document 1: Japanese Patent Laid-open Publication No. 2007-331801

Patent Document 2: Japanese Patent Laid-open Publication No. 2000-153245

Patent Document 3: Japanese Patent Laid-open Publication No. 2007-22600

Patent Document 4: Japanese Patent No. 3315918

Patent Document 5: Japanese Patent Laid-open Publication No. 2004-299723

Patent Document 6: Japanese Patent Laid-open Publication No. 2010-189034

SUMMARY OF THE INVENTION

Problem to be Solved by the Invention

As described above, when the CIP and SIP treatments are performed to the drink supply pipe line, since the manifold and the cleaning liquid supply source are connected via the pipe line, the turning motion of the filling nozzles of the filler is stopped. Because of this reason, when it is required to perform the COP and SOP treatments to the interior of the aseptic chamber at the same time of performing the CIP and SIP treatments, there causes a case such that the cleaning liquid and/or sterilizing liquid does not evenly reach to the outer surface of the filler, which will likely result in inadequate cleaning and/or sterilization. Particularly, since the filling nozzle has a complicated shape or configuration, inadequate cleaning and/or sterilization more likely cause. Moreover, since the filling nozzle is a member through which the drink fills the bottle, if bacteria or like foreign substance remains on the surface of the filling nozzle, there is a fear such that the bacteria or foreign substance may easily enter the bottle.

Then, conventional COP and SOP treatments to the interior of the aseptic chamber has been performed under a state in which it becomes possible for the filling nozzle to be turned after the completion of the CIP and SIP treatments to the drink supply pipe line and separating the connection of the pipe line between the manifold and the cleaning liquid storage tank. That is, at an instance when the filler is driven and the cleaning liquid or like is sprayed from the respective filling nozzles into the aseptic chamber while the filling nozzles being turned, the sprayed mist or shower of such as cleaning liquid is spread widely to the filler, and particularly, to the corner portions of the filling nozzles, thereby properly performing the cleaning and sterilizing treatments to the filler.

However, when it is required to perform the COP and SOP treatments to the interior of the aseptic chamber after the completion of the CIP and SIP treatments to the drink supply pipe line, a down time (i.e., time interval at which production operation stops) of the filler, eventually, entire aseptic filling apparatus is elongated, resulting in reduction of productivity of containers to be filled with the drink.

The inventor of the present invention increased the location numbers of the nozzles inside the aseptic chamber for shortening the downtime and tried to perform the COP and SOP treatment to the inside of the drink supply pipe line simultaneously with the CIP and SIP treatments to the interior of the aseptic chamber. However, it was difficult to obtain sufficient filler cleaning and sterilizing effects.

The present invention therefore aims to provide filler cleaning method and apparatus capable of solving the problems encountered in the prior art mentioned above.

Means for Solving the Problem

In order to solve the above problem, the present invention adopts the following configuration or structure.

It is further to be noted that although the description is made with parentheses to reference numerals in FIGURES, the present invention is not limited thereto.

That is, the present invention according to a first aspect adopts a method of cleaning a filler wherein at least one of COP and SOP treatments is performed by spraying a predetermined working fluid in a predetermined order from spray nozzles (17*a*, 17*b*) within an aseptic chamber (9) accommodated with a filler (1), when such at least one of the COP and SOP treatments is performed, the predetermined working fluid is blasted toward externally of the filler (1) in the predetermined order while moving a movable spray nozzle (17*b*) opposing to the filler around the filler (1) from an outer periphery thereof.

According to a second aspect of the present invention, in the filler cleaning method according to the first aspect, it may be preferred that the movable spray nozzle (17*b*) is reciprocally moved in a vertical direction along a filling nozzle (7) in the filler (1).

According to a third aspect of the present invention, in the filler cleaning method according to the first or second aspect, it may be preferred that when at least one of CIP and SIP treatments is performed with respect to a drink supplying pipe line (2) supplying the drink to the filler (1) in a state of the filler (1) being stopped in operation, at least one of the COP and SOP treatments is performed in parallel with the above at least one of the treatments.

The present invention according to a fourth aspect adopts an apparatus for cleaning a filler, wherein spray nozzles (17*a*, 17*b*) are provided for performing at least one of COP and SOP treatments by spraying a predetermined working fluid in a predetermined order within an aseptic chamber (9) accommodated with a filler, at least a movable spray nozzle (17*b*) of the spray nozzles (17*a*, 17*b*) is supported by a vertically reciprocally movable means (19), and when such at least one of the COP and SOP treatments is performed, the predetermined working fluid is blasted toward externally of the filler (1) in the predetermined order while moving the movable spray nozzle (17*b*) reciprocally in the vertical direction of the filler (1).

According to a fifth aspect of the present invention, in the filler cleaning apparatus according to the fourth aspect, it may be preferred that the movable spray nozzle (17*b*) is reciprocally movable in the vertical direction along a filling nozzle (7) in the filler (1).

According to a sixth aspect of the present invention, in the filler cleaning apparatus according to the fourth or fifth aspect, it may be preferred that when at least one of the CIP and SIP treatments is performed with respect to a drink supplying pipe line (2) supplying the sterilized drink into the filler (1) in a state of the filler (19 being stopped in operation, at least one of the COP and SOP treatments is performed in parallel with the above at least one treatment.

Effects of the Invention

According to the present invention, since a working fluid can be spread to all the corners of the outer surface of the filler (1) provided within the aseptic chamber (9), defects in the cleaning and sterilizing operations can be prevented from causing, and the proper COP and SOP treatments can be performed. Particularly, since the filling nozzle (7) disposed in the filler (1) has a complicated shape and configuration, defects in cleaning and sterilizing treatments may be likely caused, but according to the present invention, bacteria or like foreign substance can be surely prevented from remaining on the surface of the filling nozzle (7), and hence, dangerous fear of the bacteria and the like foreign substance entering the container such as a bottle b can be overcome.

Furthermore, in the present invention, in a case when at least one of the CIP and SIP treatments is performed in a state of the filler being stopped in operation with respect to the drink supplying pipe line (2) supplying the drink into the filler (1), if at least one of the COP and SOP treatments is performed in parallel therewith, at least one of the COP and SOP treatments can be performed at the same period as at least one of the CIP and SIP treatments, so that the drink filling working can be smoothly started, thereby shortening the production stopping period of the aseptic filling system such as filler and the inter-production period at the drink changing time, and hence, enhancing production efficiency.

BRIEF DESCRIPTION OF THE DRAWINGS

FIG. 1 is a schematic diagram showing a filler and an aseptic chamber to be cleaned by the cleaning method according to the present invention, in which a left half shows a state of a drink filling process and a right half shows a state during cleaning treatment or sterilizing treatment.

DETAILED DESCRIPTION OF THE INVENTION

An embodiment of the present invention will be explained hereunder with reference to the accompanying drawings.

A drink supplying pipe line 2 for supplying drink to a filler 1 shown in FIG. 1 from a drink preparation tank, not shown, is provided for an aseptic filling system. In FIG. 1, reference 3 denotes a surge tank provided on the way of the drink supply pipe line.

The aseptic filling system is also provided with a bottle conveying path for conveying or delivering a bottle b, as a container to be filled with the drink, to the filler 1, and conveying the bottle b filled up with the drink to a capper, not shown, by the filler 1. The conveying path is generally composed of a number wheel rows and grippers 4 and others disposed around the respective wheels.

The filler 1 is a filling machine for filling a number of bottles b with the drink at a high speed, and as shown in FIG. 1, is provided with a wheel 5 constituting a part of the bottle conveying path. The wheel 5 is mounted to a portion as a turning shaft 6*a* in a support shaft 6 vertically standing from a floor surface of the aseptic filling system. Grippers 4, each for gripping a neck portion of the bottle b, are arranged at constant pitch around the wheel 5. The grippers 4 are capable of being turned in one direction together with the wheel 5. Furthermore, a number of filling nozzles 7 arranged at the same pitch as that of the grippers 4 are also arranged around the wheel 5.

An upper portion of the support shaft 6 for stopping the turning motion is fixed to a machine frame of the filler 1, and a rotary joint 6*b* is disposed between the upper portion of the support shaft 6 and the turning shaft portion 6*a*. An upper manifold 8 is further provided to the turning shaft portion 6*a* below the rotary joint 6*b*. The support shaft 6 has a hollow portion extending from the upper portion of the support shaft 6 to the upper manifold 8, and the drink supply pipe line 2 is coupled with the upper portion of the support shat 6. The drink supply pipe line 2 extends to the respective filling nozzles 7 from the upper manifold 8.

When the filler 1 is driven, the wheel 5 is rotated at high speed, and the bottles b gripped by the grippers 4 are conveyed on the conveying path in synchronism with the rotating motion of the wheel 5. During this conveyance, when the bottles b are moved directly below the nozzle openings 7*a* of the corresponding filling nozzles 7, the bottles b are subsequently filled with the constant amount of the drink respectively.

The filler 1 is accommodated entirely within the aseptic chamber 9, as shown in FIG. 1, so as to fill the bottle b, which has been subjected to the sterilizing treatment, with the sterilized drink to prevent foreign substance such as bacteria from entering the bottle b. The aseptic chamber 9 is provided with an inlet port and an outlet port at its upstream side and downstream side though not shown in FIG. 1.

As described above, the drink is supplied from the drink preparation apparatus toward the filling nozzles 7 of the filler 1 by way of the drink supply pipe line 2, the inside of which is subjected to the CIP and SIP treatments periodically or every time of changing the kind of drinks.

The CIP treatment is performed by flowing a working liquid for cleaning such as water, alkaline cleaning agent, acidic cleaning agent or like inside the drink supply pipe line 2 in accordance with the predetermined procedure. Further, the SIP treatment is also performed by flowing a working liquid for sterilization such as sterilizing liquid, heated water, steam or like inside the drink supply pipe line 2.

In FIG. 1, reference numeral 10 denotes a reservoir (storage) tank as a supply source of a working liquid such as cleaning liquid or sterilizing liquid. Reference numeral 11 denotes a liquid feed pump. Although a plurality of reservoir tanks 10 may be provided in conformity with the kinds of predetermined working fluids, only one is described on FIG. 1 for the sake of convenience of drawing the FIGURE, and a supply source for the working liquid for the sterilization, for example, is omitted for showing in FIG. 1. Furthermore, in FIG. 1, reference numeral 12 denotes a supply pipe line from the reservoir tank 10 to the surge tank 3, and reference numeral 13 denotes a return pipe line from each filling nozzle 7 to the reservoir tank 10. The supply pipe line 12 and the return pipe line 13 constitute a circulation path line together with the drink supply pipe line for the cleaning liquid and the like.

The return pipe line 13 has a starting terminal end to which a cup 14 is provided to be capable of approaching or separating from the nozzle opening 7*a* of each filling nozzle 7. When the CIP and SIP treatments are performed, each cup 14 is applied, by an actuator, not shown, to the nozzle opening 7*a* formed to the front end of the corresponding filling nozzle 7, and hence, the starting terminal end of the return pipe line 13 is connected to the filling nozzle opening 7*a*. The respective cups 14 are coupled with a lower manifold 15 by flexible pipes forming a part of the return pipe line 13. The lower manifold 15 is mounted to the turning shaft 6*a* of the filler 1 to be turnable together with the wheel 5, the filling nozzles 7 and so on.

A joint 16 is provided to a portion at which the return pipe line 13 extends from the lower manifold 15 to the reservoir tank 10 in a manner of being connected or disconnected. This joint 16 is connected at the time when the CIP and SIP treatments are performed, and at such time, the wheel 5 and the filling nozzles 7 are not turnable. Upon the completion of the CIP and SIP treatments, since the joint 16 is disconnected, the wheel 5 and the filling nozzles 7 become turnable.

As like as the CIP treatment and the SIP treatment performed to the inside of the drink supply pipe line 2, the inside of the aseptic chamber 9 is also subjected to the COP treatment and the SOP treatment for cleaning.

The COP and SOP treatments are performed by spraying a predetermined working liquid such as chemical liquid such as hydrogen peroxide, aseptic water and like liquid in order into the aseptic chamber 9 in form of spray or shower.

In FIG. 1, reference numerals 17*a* and 17*b* denotes spray nozzles, respectively, disposed to various portions between the inner wall surface of the aseptic chamber 9 and the outer surface of the filler 1.

The spray nozzles 17*a* are fixed-type spray nozzles fixed to predetermined portions inside the aseptic chamber 9, and the spray nozzles 17*b* are movable-type nozzles disposed to be movable in the vertical direction.

As shown in FIG. 1, a number of the movable spray nozzles 17*b* are disposed, at a predetermined pitch, to the inside of a circular pipe 18 provided so as to surround the filler 1 from the outer side thereof. Such circular pipe provided with the movable spray nozzles may be provided in plural stages, and in a desirable layout, the movable spray nozzles 17*b* are arranged so as to face the filling nozzles 7, respectively.

The circular pipe 18 is supported by movable means to be vertically reciprocally movable along the outer periphery of the filler when this movable means is driven. More specifically, as shown in FIG. 1, the circular pipe 18 is coupled with a rod 19*a* of an air-cylinder device 19, as an actuator, perpendicularly fixed to the machine frame of the filler 1 or the wall portion of the aseptic chamber 9. In a preferred layout, the air-cylinder device 19 is fixed to an external portion of the ceiling of the aseptic chamber 9 so that the rod 19*a* projects inside the aseptic chamber 9. Because of such arrangement, a portion between the inner wall surface of the aseptic chamber 9 and the rod 19*a* is shut off by a bellows in order to prevent outer air from entering the interior of the aseptic chamber 9. In FIG. 1, although only two air-cylinder devices 19 are illustrated, it may be possible to locate three or more air-cylinders.

Reference numeral 21 denotes a reservoir (storage) tank as a supply source for a predetermined working liquid such as alkaline cleaning agent, acetyl hydroperoxide cleaning agent, chemical solution of hydrogen peroxide water, aseptic water or the like. Although a plurality of such reservoir tanks 21 are provided for respective chemical solutions such as hydrogen peroxide water or the like and the aseptic water or the like, only one thereof is shown in FIG. 1 for the sake of convenience. Furthermore, reference numeral 22 denotes a supply pipe line extending from each reservoir tank 21 to each fixed spray nozzle 17*a*, and reference numeral 23 denotes a flexible supply pipe line extending from each reservoir tank 21 to each movable spray nozzle 17*b*. More specifically, the flexible supply pipe line 23 is connected to the circular pipe 18. Pumps 24 are provided for the supply pipe lines 22 and 23, respectively.

During the CIP treatment or SOP treatment, the rod 19*a* of the air-cylinder device 19 performs the reciprocal motion in the vertical direction along the outer periphery of the filler 1 together with the circular pipe 18. At the same time, the chemical solution for the CIP and SOP treatments and the predetermined working fluid such as aseptic water are sprayed outward of the filler 1 by means of the movable spray nozzles 17*b* in accordance with the predetermined order to thereby spray the chemical solution or like to the outer surface of the filler 1 to clean up foreign substance from the outer surface of the filler 1.

Incidentally, the process of the circular pipe 18 may be set so as to follow the outer surfaces of the filling nozzles 7 of the filler 1 in the vertical direction. According to such setting, the filling nozzles each having a complicated shape and configuration or structure can be more surely and closely cleaned and sterilized.

Next, the cleaning working by the cleaning device of the filler of the structure mentioned above will be described.

(1) Upon the stopping of the operation of the filler 1, the turning motions of the filling nozzles 7 and so on are then stopped to take static positions, and the surge tank 3 is made empty.

(2) As shown on right half of FIG. 1, the opening (mouth) portion 7*a* of each of the filling nozzles 7 is closed by the cup 14. The joint 16 is then connected. Accordingly, the circulation path line for flowing the predetermined working fluid or solution such as cleaning liquid, sterilizing liquid and the like at the time of performing the CIP and SIP treatments.

(3) When the CIP treatment is started, the alkaline cleaning agent and the predetermined working fluid such as water are delivered from the reservoir tank 10 by means of pump 11 in accordance with the predetermined order. The cleaning liquid and the like flows from the reservoir tank 10 to the surge tank 3 through the supply pipe line 12, then flows into the upper manifold 8 through the drink supply pipe line 2 and then to the respective filling nozzles 7, and thereafter, flows to return to the reservoir tank 10 through the return pipe line 13. According to such flowing, the cleaning liquid and the like flows within the circulation path for the predetermined time according to the predetermined order, thereby cleaning the interior of the drink supply pipe line 2 including the interior of the filling nozzles 7.

(4) After the completion of the CIP treatment, the SIP treatment is started, and a predetermined working fluid such as heated water or heated steam flows in the circulation path mentioned above for the predetermined time, thereby sterilizing the interior of the drink supply pipe line 2 including the interior of the filling nozzles 7.

(5) At the same time when the CIP treatment and the SIP treatment mentioned above are performed, the COP treatment and the SOP treatment are performed, in parallel to the above treatments, to the interior of the aseptic chamber 9.

The COP and SOP treatments are performed by delivering the predetermined working fluid such as cleaning liquid, sterilizing liquid and the like from each of the respective reservoir tanks 21 in accordance with the predetermined order by means of pump 24. The cleaning liquid and the like are sprayed in form of mist or shower from the fixed spray nozzles 17*a* and movable spray nozzles 17*b* through the supply pipe lines 22 and 23 and then blasted to the outer surface of the filler 1 and the like within the aseptic chamber 9.

Further, the movable spray nozzle 17*b* blasts the cleaning liquid, the sterilizing liquid and the like toward the exterior of the filler 1 in the predetermined order while moving reciprocally in the vertical direction together with the circular pipe 18 by the actuation of the air-cylinder device 19. According to this operation, the outer surface of the filler 1, particularly, the outer surfaces of the filling nozzles 7 having complicated shape and configuration can be cleaned and sterilized with improved accuracy.

Furthermore, since the COP and SOP treatments are performed in parallel with the CIP and SIP treatments, the downtime of the aseptic filling system including the filler 1 can be shortened and the productivity for filling the container with drink can be improved.

Further, the COP and SOP treatment to the interior of the aseptic chamber 9 may be performed after the CIP and SIP treatments have been performed. In such case, it is preferred to perform the COP and SOP treatments during the turning motion of the filler 1 after the disconnection of the joint 16. By blasting the cleaning liquid and the sterilizing liquid during the time of turning the filler 1 together with the filling nozzles 7 at high speed, the cleaning effect and the sterilizing effect can be enhanced.

(6) After the completion of the CIP, SIP, COP and SOP treatments, the joint 16 connected for the CIP and SIP treatments is disconnected, and then, as shown in the left half of FIG. 1, the cups 14 are removed from the nozzle openings 7*a* of the respective filling nozzles 7.

(7) Then, the drink filling working starts. The drink is prepared by the preparation device, not shown, and the drink subjected to the sterilizing treatment is fed to the interior of the filler 1 through the cleaned surge tank 3 and the drink supply pipe line 2, and fills the bottles b as containers through the respective filing nozzles 7 of the filler 1.

The bottle b filled up with the drink is transferred from the gripper 4 on the side of the wheel 5 of the filler 1 to a gripper on the side of the wheel of a capper, not shown, and then, the opening (mouth) portion of the bottle b is closed with the sterilized cap by the capper and discharged outward of the aseptic filing system.

It is to be noted that although the present invention has the structure as described above, the present invention is not limited to such embodiment, and many other changes and modifications may be made within the scope of the present invention.

For example, the movable filling nozzle of the structure described above may be disposed so as to stand upward from the floor side of the aseptic filling system. Furthermore, the chamber is not limited to have an aseptic structure, and may be constructed to have a shroud structure such as utilized for a clean room. The container is not limited to a bottle, and a paper container may be alternatively used.

Furthermore, when both the CIP and SIP treatments are performed for the drink supply pipe line, although both the COP and SOP treatments are performed in the described embodiment for the interior of the aseptic chamber, it may be possible to perform the COP treatment at the time of performing the CIP treatment, to perform the SOP treatment at the time of performing the CIP treatment, to perform the COP treatment at the time of performing the SIP treatment, to perform the SOP treatment at the time of performing the SIP treatment, to perform both the COP and SOP treatments at the time of performing the CIP treatment, to perform the COP treatment at the time of performing the SIP treatment, to perform the SOP treatment at the time of performing the SIP treatment, to perform both the COP and SOP treatments at the time of performing the SIP treatment, to perform the COP treatment at the time of performing both the CIP and SIP treatments, and to perform the SOP treatment at the time of performing both the CIP and SIP treatments.

REFERENCE NUMERALS

1 filler
2 drink supply pipe line
7 filling nozzle
9 aseptic chamber
17*a* fixed spray nozzle
17*b* movable spray nozzle
19 air-cylinder device
b bottle

The invention claimed is:

1. A method of cleaning a drink filler, wherein SOP (Sterilizing out of Place) treatments are performed by spraying a predetermined working fluid from fixed-type spray nozzles and movable-type spray nozzles, the movable-type spray nozzles being disposed to be movable in a vertical direction within an aseptic chamber containing the filler, the fixed-type spray nozzles being fixed to predetermined portions inside the aseptic chamber and the movable-type spray nozzles being disposed, at a predetermined pitch, inside of a circular pipe so as to surround the filler, the circular pipe being coupled with a movable rod connected to an air cylinder, which moves the rod in the vertical direction, wherein when SOP treatments are performed, the predetermined working fluid is blasted toward an outer surface of the filler from the fixed-type spray nozzles and the movable-type spray nozzles, such that the movable-type spray nozzles blast the predetermined working fluid while moving in the vertical direction; and when the SOP treatments are performed, performing simultaneously, in parallel, SIP (Sterilizing in Place) treatments on a drink supplying pipe line that is configured to supply drink to the filler, wherein the SIP treatments are performed while turning motion of the filler is stopped such that the filler is static, and wherein the SIP treatments comprise flowing a predetermined liquid through the drink supplying pipe line.

2. An apparatus for cleaning a filler, wherein the apparatus comprises fixed-type spray nozzles and movable-type spray nozzles, the movable-type spray nozzles being disposed to be movable in a vertical direction within an aseptic chamber containing the filler, wherein the fixed-type spray nozzles and the movable-type spray nozzles are provided for performing SOP (Sterilizing out of Place) treatments by spraying a predetermined working fluid within the aseptic chamber containing the filler, the fixed-type spray nozzles being fixed to predetermined positions inside the aseptic chamber and the movable-type spray nozzles being disposed, at a predetermined pitch, inside of a circular pipe so as to surround the filler, the circular pipe being coupled with a movable rod connected to an air cylinder, which moves the rod in the vertical direction, such that the movable-type spray nozzles are configured to blast the predetermined working fluid while moving in the vertical direction; and wherein the apparatus is configured to perform simultaneously, in parallel to performing the SOP treatments, SIP (Sterilizing in Place) treatments on a drink supplying pipe line configured to supply drink to the filler, wherein the SIP treatments are performed while turning motion of the filler is stopped such that the filler is static, and wherein the apparatus comprises a cup that can selectively be moved adjacent to a filler nozzle of the filler such that SIP liquid flowed through the drink supplying pipe line can be received by the cup and exhausted through a return pipe line directly connected to the cup.

* * * * *